US009595210B1

(12) United States Patent
Rauckman et al.

(10) Patent No.: US 9,595,210 B1
(45) Date of Patent: Mar. 14, 2017

(54) CABLE MARKING SYSTEM

(71) Applicant: GATO ASSETS, LLC, Belleville, IL (US)

(72) Inventors: James B. Rauckman, Swansea, IL (US); David W. McGuire, Jerseyville, IL (US)

(73) Assignee: Gato Assets, LLC, Belleville, IL (US)

( * ) Notice: Subject to any disclaimer, the term of this patent is extended or adjusted under 35 U.S.C. 154(b) by 0 days.

(21) Appl. No.: 15/077,618

(22) Filed: Mar. 22, 2016

Related U.S. Application Data

(60) Provisional application No. 62/136,928, filed on Mar. 23, 2015.

(51) Int. Cl.
*G09F 3/00* (2006.01)
*G09F 3/16* (2006.01)

(52) U.S. Cl.
CPC ..... *G09F 3/0295* (2013.01); *G09F 3/16* (2013.01)

(58) Field of Classification Search
CPC ..... G09F 3/0295; G09F 3/16
See application file for complete search history.

(56) References Cited

U.S. PATENT DOCUMENTS 1,703,609 A * 2/1929 Gastrow ..... H01B 7/368 40/316
2,020,780 A * 11/1935 Hamilton ..... G09F 3/16 40/310
6,237,263 B1 * 5/2001 Hagstrom ..... G09F 3/205 40/316
7,963,056 B1 * 6/2011 Mangone, Jr. ..... G09F 3/205 24/459
2004/0098890 A1 * 5/2004 Mellgren ..... G09F 3/205 40/316

OTHER PUBLICATIONS

Rauckman Utility Website, URD Tagging Device, http://www.rauckmanutility.com/URD-tagging.htm, 2 pages, admitted prior art.

* cited by examiner

*Primary Examiner* — Gary Hoge
(74) *Attorney, Agent, or Firm* — Senniger Powers LLP

(57) ABSTRACT

A marking system for displaying usable information on URD cables comprising at least one marker comprising a clip and a placard, the clip having a first and second leg and being dimensioned to snugly engage a URD cable.

20 Claims, 11 Drawing Sheets

CABLE MARKING SYSTEM

CROSS REFERENCE TO RELATED APPLICATIONS

This application claims priority to U.S. Provisional Patent Application No. 62/136,928, filed Mar. 23, 2015, which is hereby incorporated by reference in its entirety.

FIELD

The present disclosure relates to safety equipment and systems of use for electrical power distribution equipment such as underground resident distribution (URD) cable, and more particularly to a device for marking an individual cable near where it attaches to a transformer or the like and providing useful information such as safety information and identifying indicia.

BACKGROUND

In many residential subdivisions, local building regulations require that all utilities such as electricity, telephone, gas, water, cable television, etc. be installed underground. Electricity is carried by underground residential distribution (URD) systems. A system comprises various types of components, including cables, transformers, switchgear and protective devices. URD systems are most often fed from overhead primary distribution lines. The URD system is connected to the overhead system at one or more cable poles or riser poles. From the cable pole the URD cable runs down the pole and continues underground. The underground cable runs to a transformer that converts the higher voltage from the overhead primary line down to a lower or secondary voltage that is distributed to individual customers. It will be understood that a number of branch lines or secondary cables run underground from the transformer to the various customers.

Because only a relatively short length of the secondary cable is visible before it enters the ground, and because there are numerous secondary cables exiting any given transformer, there exists a risk of misidentification of a secondary cable during repair. Moreover, repair personnel inspecting the transformer may not be aware if one or more of the secondary cables is under repair at a site remote from the transformer, which could create a hazard for repair personnel at the remote site. Also, there may be abandoned secondary cables connected at the transformer.

It would be advantageous, therefore, to have an apparatus for connecting to a URD cable that indicates the status of the cable.

SUMMARY OF THE DISCLOSURE

One aspect of the present invention is directed to a marker for marking a URD cable. The marker includes a clip including opposing first and second legs. The legs are configured for receiving the URD cable therebetween for mounting the clip on the URD cable. The marker includes a placard having a face for displaying information related to the URD cable. The clip includes an attachment structure and the placard includes an attachment interface. The attachment structure and attachment interface are configured for mating connection with each other for mounting the placard on the clip.

Another aspect of the present invention is directed to a marker for marking a URD cable. The marker includes a clip having opposing first and second legs. The legs are configured for receiving the URD cable therebetween for mounting the clip on the URD cable. The marker includes a placard formed separately from and connected to the clip. The placard has a face for bearing and displaying information related to the URD cable. The connection of the placard to the clip prevents rotation of the placard with respect to the clip.

Another aspect of the present invention is directed to a method of mounting a marker on a URD cable. The method includes pushing a clip of the marker onto the URD cable such that the URD cable is received between opposing legs of the clip for mounting the clip on the URD cable. The method also includes displaying information related to the URD cable on a placard of the marker rigidly supported by the clip.

Other objects and features of the present invention will be in part apparent and in part pointed out herein.

DETAILED DESCRIPTION

The cable marking system disclosed herein is designed to be used with URD cables. By way of example, the system is designed to be used with secondary URD cables, or the system may be used with primary distribution lines. One example of a secondary URD cable is a cable that extends underground from an electrical transformer to a customer to supply electrical power to the customer. The electrical transformer generally is energized by an overhead primary distribution line. However, the system can be used in any environment and is not limited to the electric distribution industry.

Figure 1:
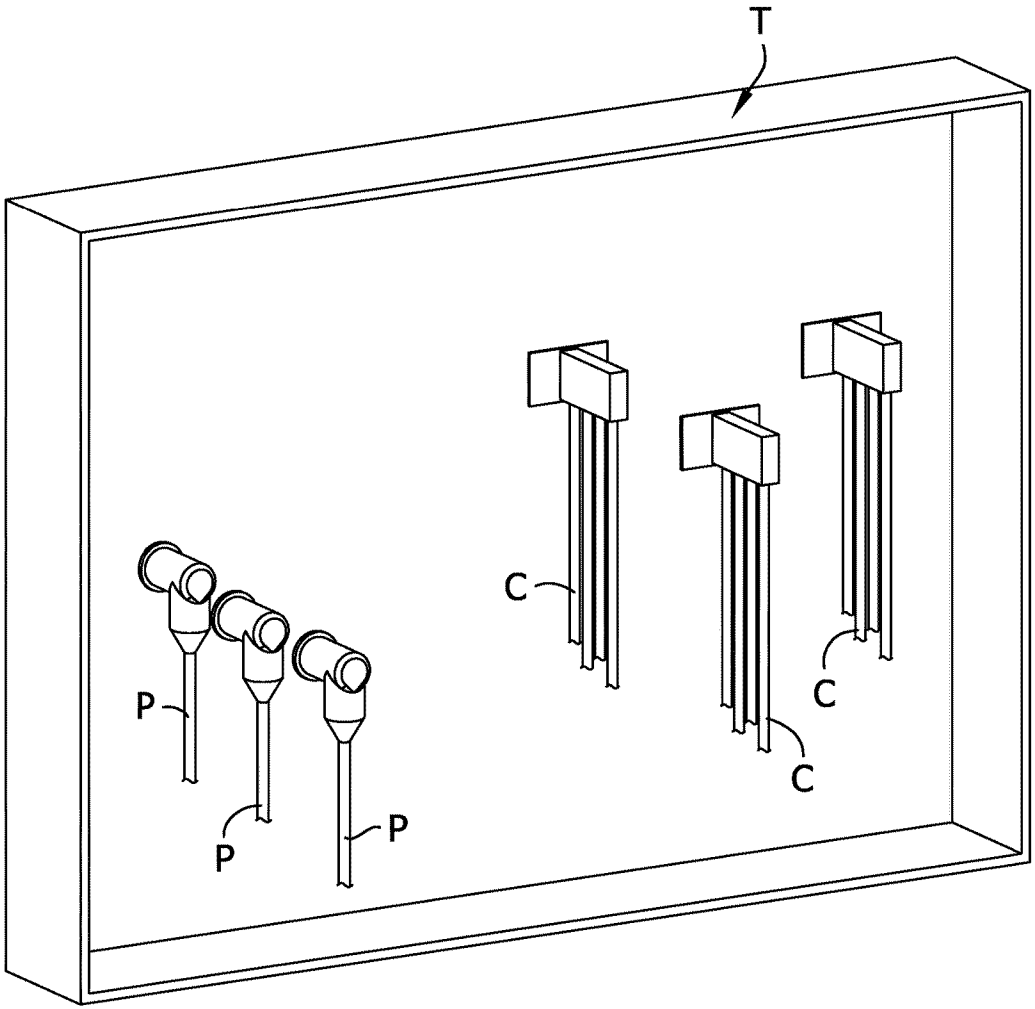
FIG. 1 is a front perspective of an open transformer showing secondary URD cables exiting the transformer.

A representative example of a transformer is shown in FIG. 1 and indicated generally by letter T. It will be understood that transformer T is energized by an overhead primary distribution line or other means. The function of transformer T is conventional and known to the art. Generally speaking, transformer T converts higher voltage from an overhead primary line P down to a lower or secondary voltage that is distributed to individual customers.

As seen in FIG. 1, a plurality of secondary URD cables, each indicated generally by C, exit the transformer T. Each cable C extends between the transformer T and a customer. There may be any number of cables C and customers associated with any given transformer. The customer most commonly is a private residence, but may be an apartment complex, business, school, church or any other structure that requires electrical service.

The majority of the length of a cable C is buried underground between the transformer T and the customer site. However, as seen, there is a substantial length of each cable C accessible within the cable compartment of the transformer T. There may be a bewildering array of cables C exposed in the transformer T. It likely is not readily apparent to a service technician inspecting the transformer which cable C might be the cause of a service problem, or if another technician is working at a customer site on the remote end of a cable C, or if a cable C is abandoned and so forth.

The disclosed marking system is used to mark one or more cables C where the cable is exposed, for example, at the transformer T. The marking system may be used to indicate a cable running to a customer site under repair, an abandoned cable, a faulty cable, or the like. The marking system not only allows a service technician to identify the various cables C, but enhances the safety of the technician at the transformer as well as a technician working remotely from the transformer.

Figure 2:
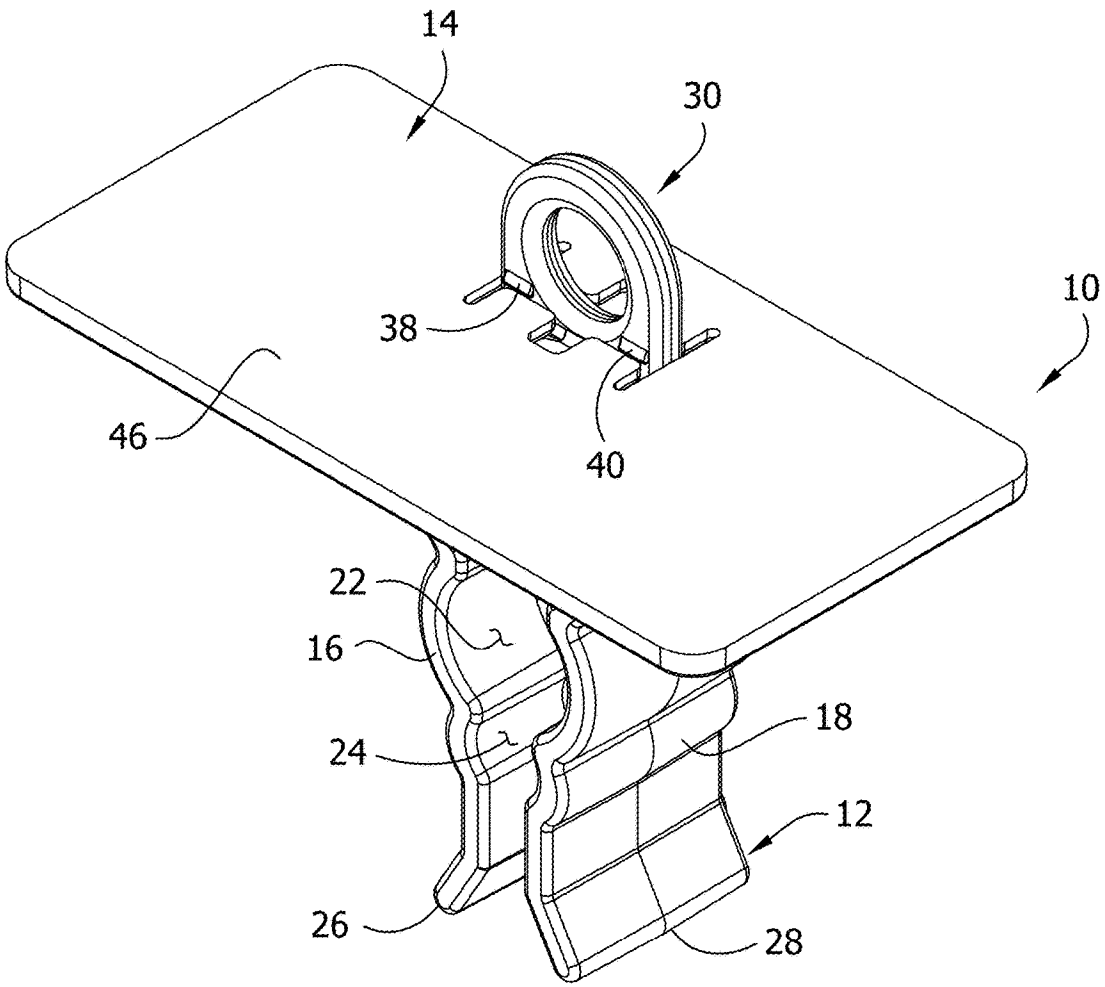
FIG. 2 is a top perspective of an embodiment of a marker for a URD cable.
Figure 3:
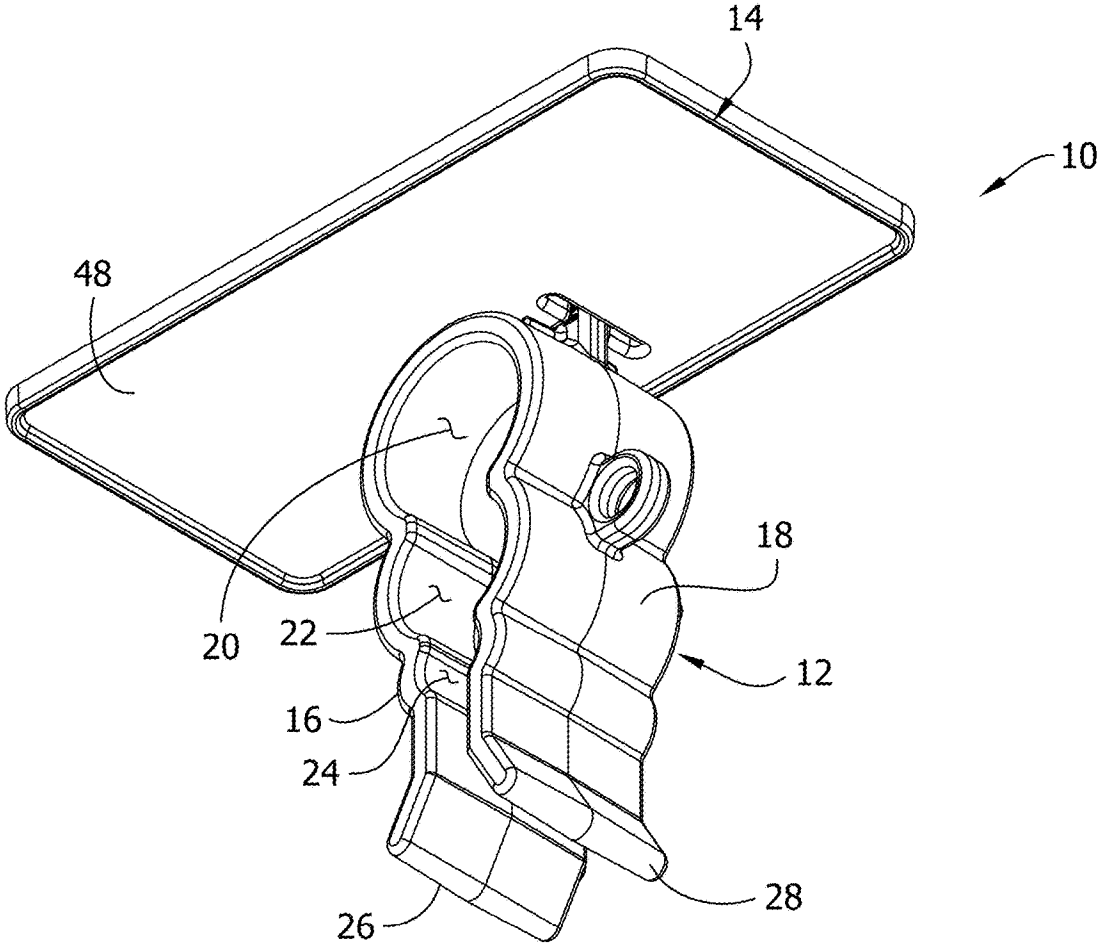
FIG. 3 is a bottom perspective of the marker of FIG. 2.
Figure 4:
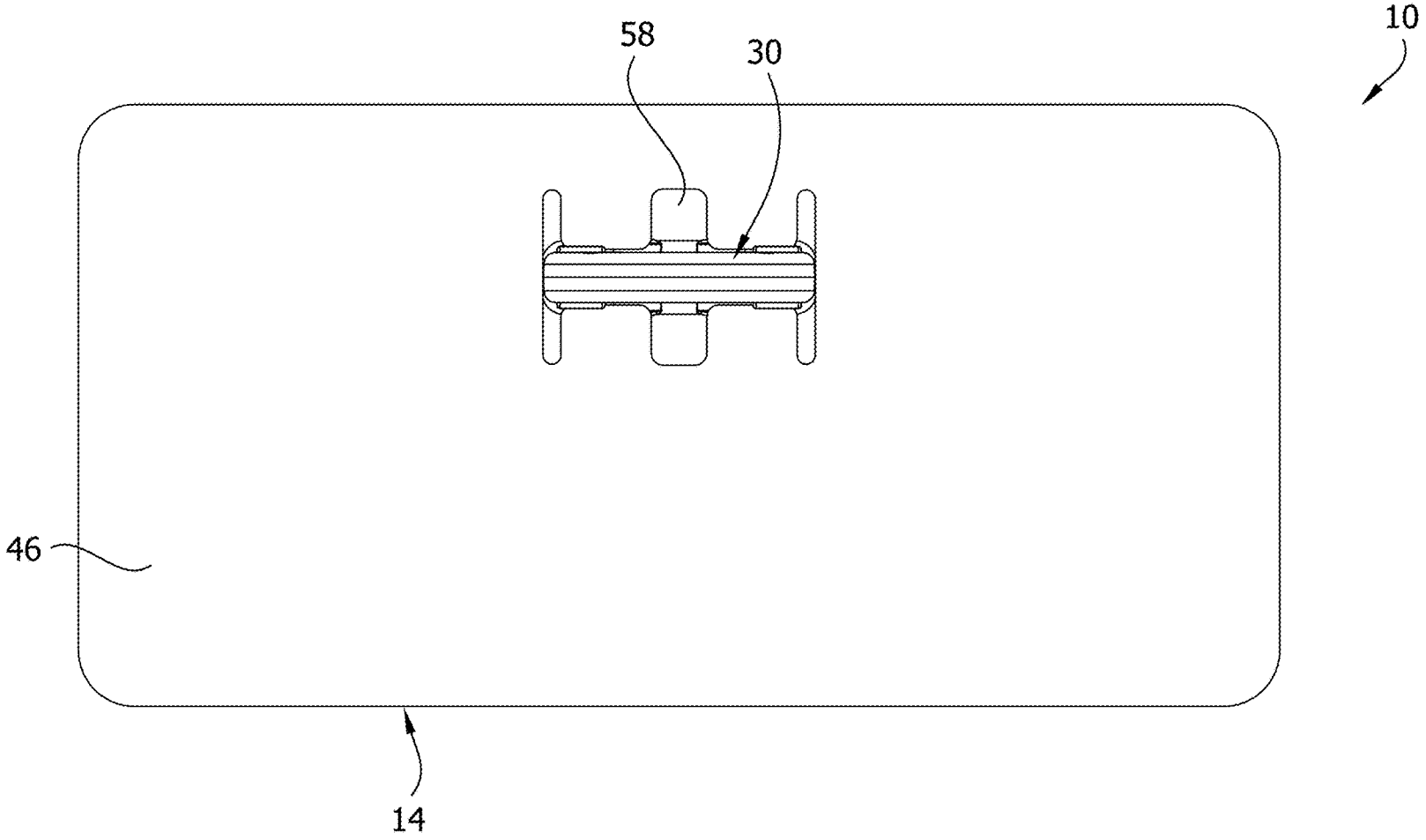
FIG. 4 is top plan view of the marker.

Referring to FIGS. 2 and 3, the marking system comprises a marker, indicated generally by number 10. The marker 10 includes a cable clip 12 and a placard 14. The clip 12 includes a first leg 16 and an opposed second leg 18. The opposed legs are configured to define a first semicircular space 20 at a first or proximal end, a second, smaller semicircular space 22 distal to the first and a substantially smaller third semicircular space 24 distal to the second. The distal end of each arm terminates in an outwardly directed foot 26 and 28.

It will be understood that first semicircular space 20 is configured and dimension to fit snugly around a URD cable. Moreover, it will be understood that the first, second, and third semicircular spaces 20, 22, 24 are sized for mounting the clip on cables of different sizes, the space 20 being sized for mounting on a relatively large cable, the space 22 being sized for mounting on a smaller cable, and the space 24 being sized for mounting on yet a smaller cable. The clip 12 can be constructed from a resilient material, such as molded plastic so that the legs 16, 18 can be urged apart for positioning the clip on a cable C and biased toward each other to secure the clip in place on the cable.

Figure 10:
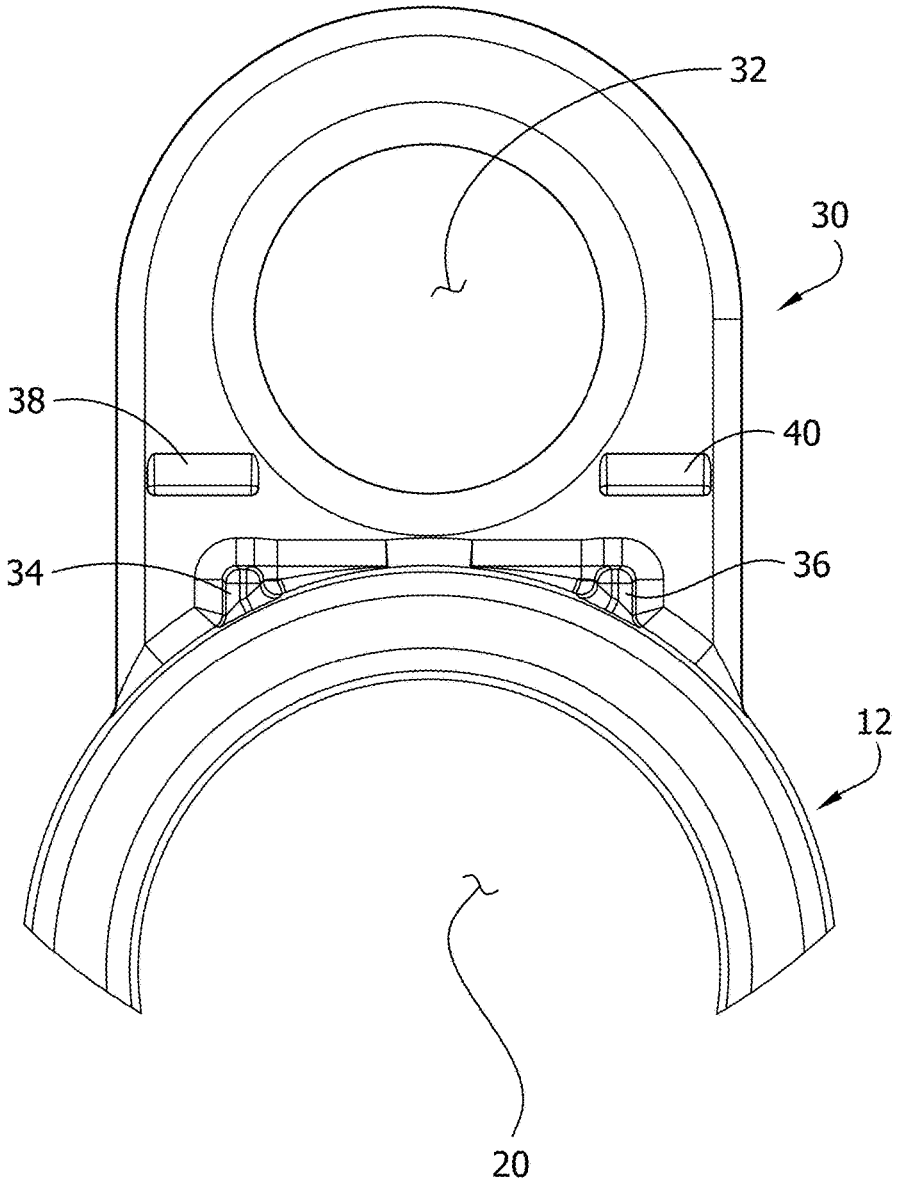
FIG. 10 is an enlarged fragmentary front elevation of an attachment structure of the marker.
Figure 11:
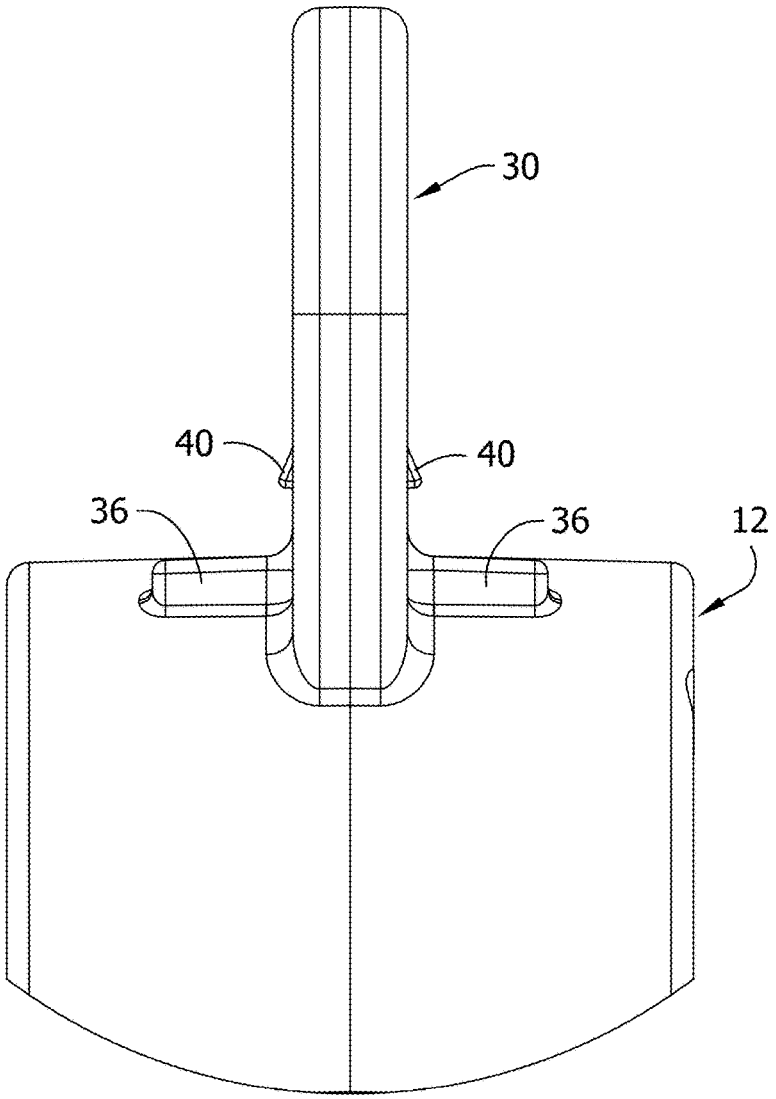
FIG. 11 is an enlarged fragmentary side elevation of the attachment structure.

Referring now to FIGS. 4-11, there is an attachment structure 30 at the extreme proximal end of the clip 12. The attachment structure is used to attach the marker 10 to a cable C and to attach the placard 14 to the clip 12. As best seen in FIGS. 10 and 11, the attachment structure 30 is a flat, concentric extension or protrusion at the proximal end of the clip 12. The structure 30 defines a circular opening 32. The structure 30 may be grasped by a user, either by hand or with a hotstick through the opening 32, for application or removal of the marker. There is a pair of raised bosses 34 and 36 on each side of the structure 30 extending partially across the top of the clip 12. Furthermore, each side of the structure 30 includes a pair of angled detents 38 and 40 protruding from the surface of the structure.

Figure 5:
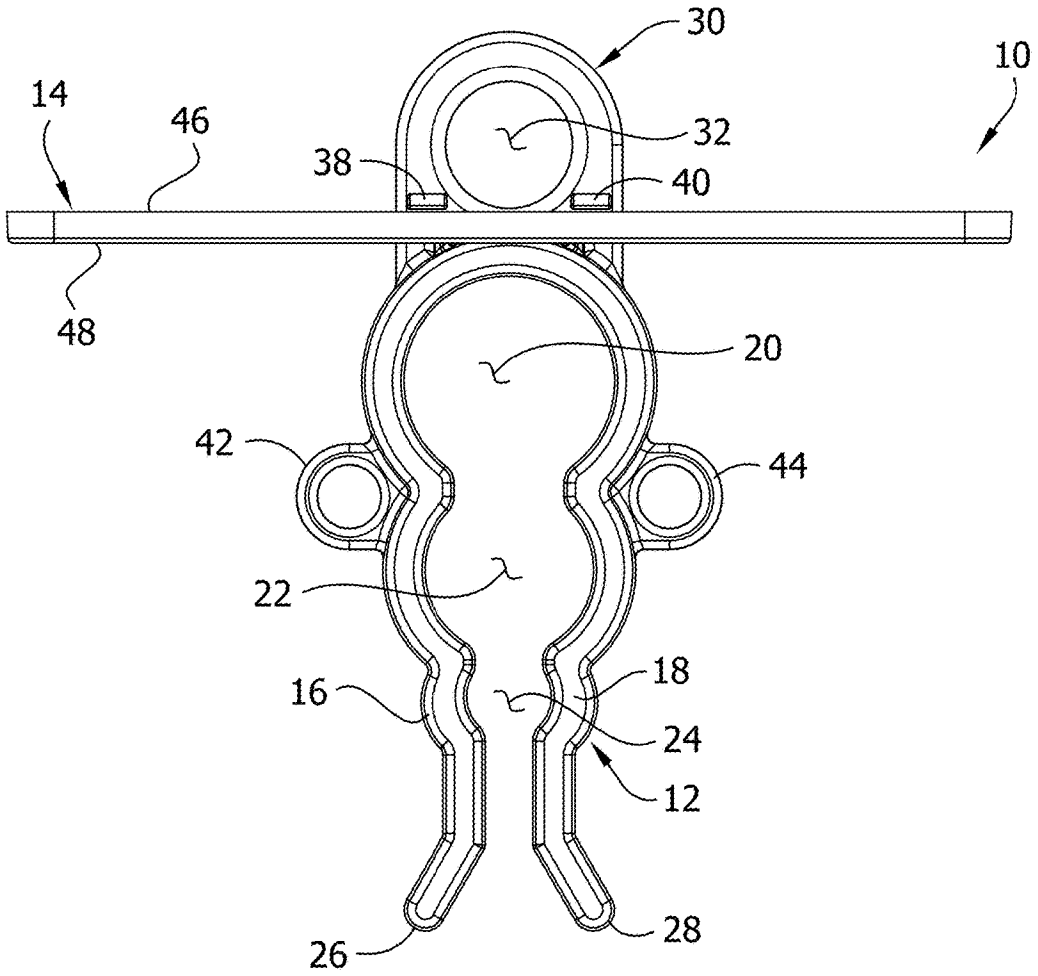
FIG. 5 is a front elevation of the marker.
Figure 6:
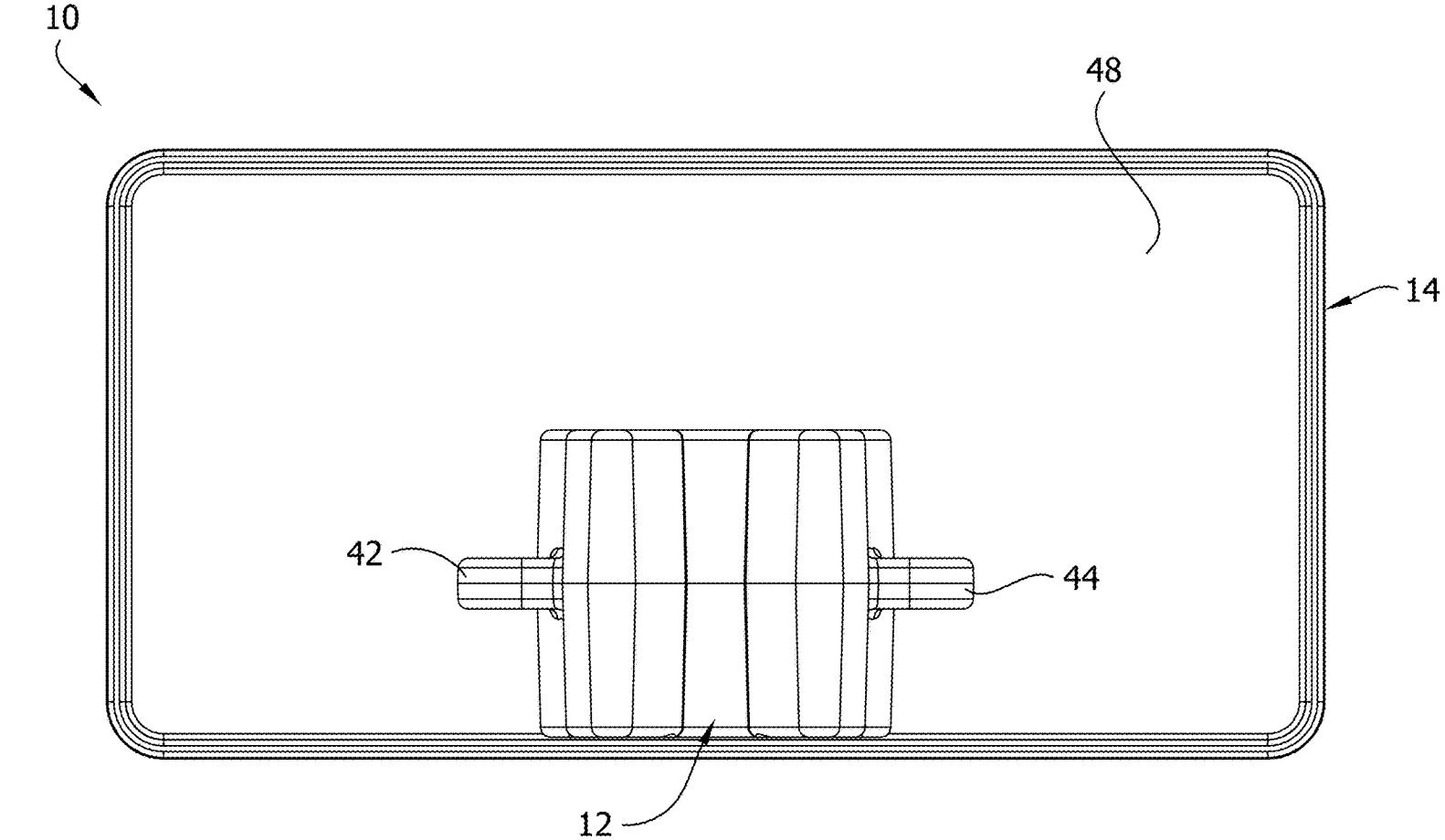
FIG. 6 a bottom plan view of the marker.
Figure 7:
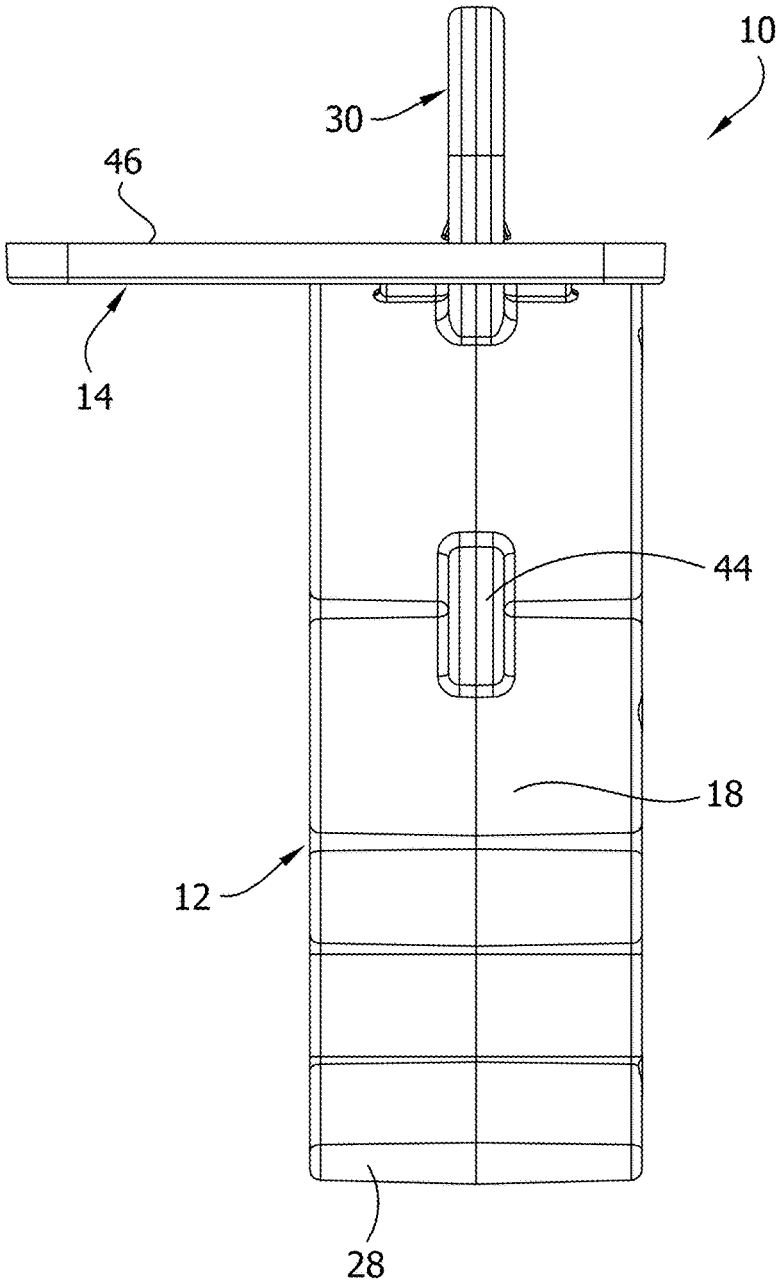
FIG. 7 is a right side elevation of the marker, the left side of the marker being identical.

The clip 12 includes a first eyelet 42 extending laterally from the leg 16 and a second eyelet 44 extending laterally from the leg 18 (see, FIG. 5). The eyelets 42 and 44 provide attachment points for attaching tags or other structures.

Figure 8:
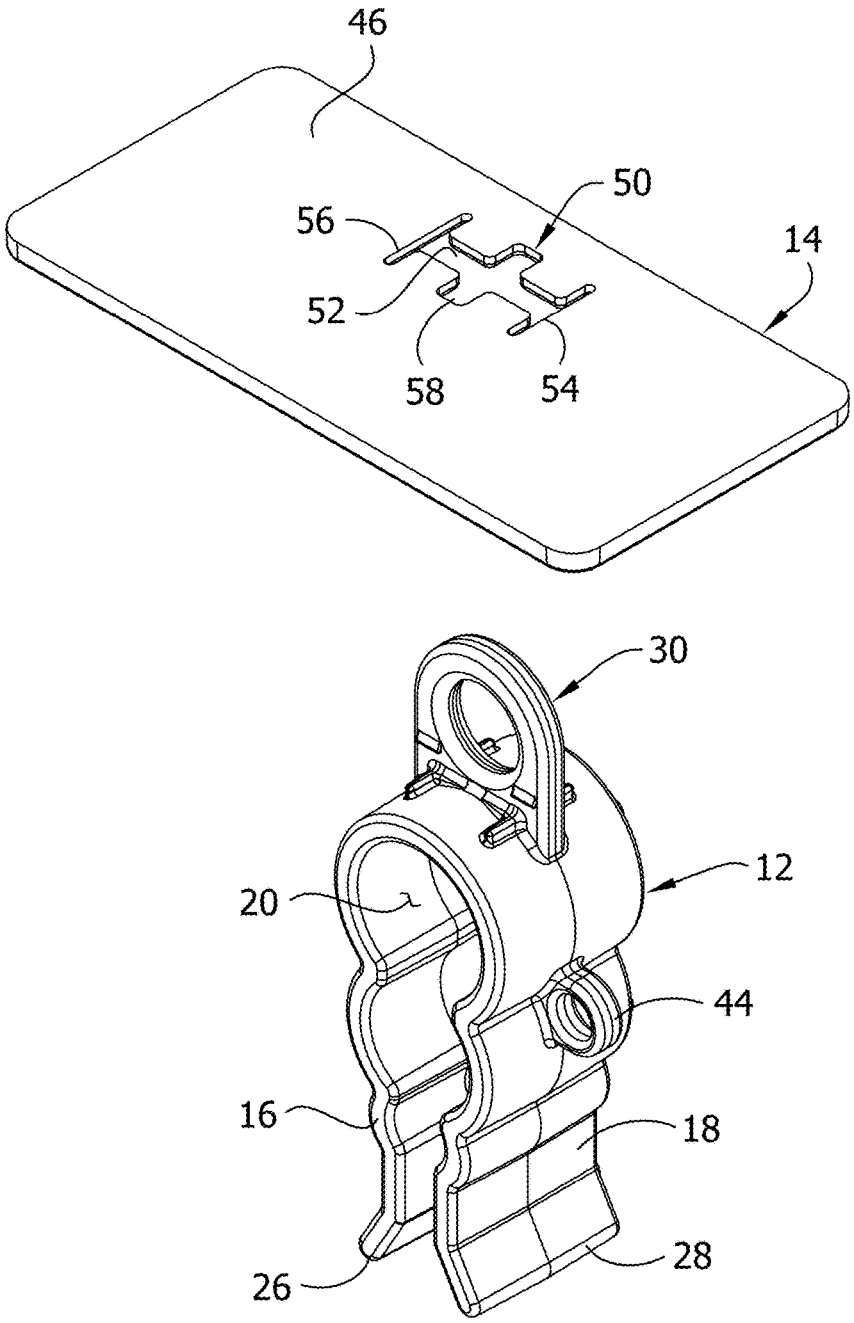
FIG. 8 is a top perspective of the marker disassembled.
Figure 9:
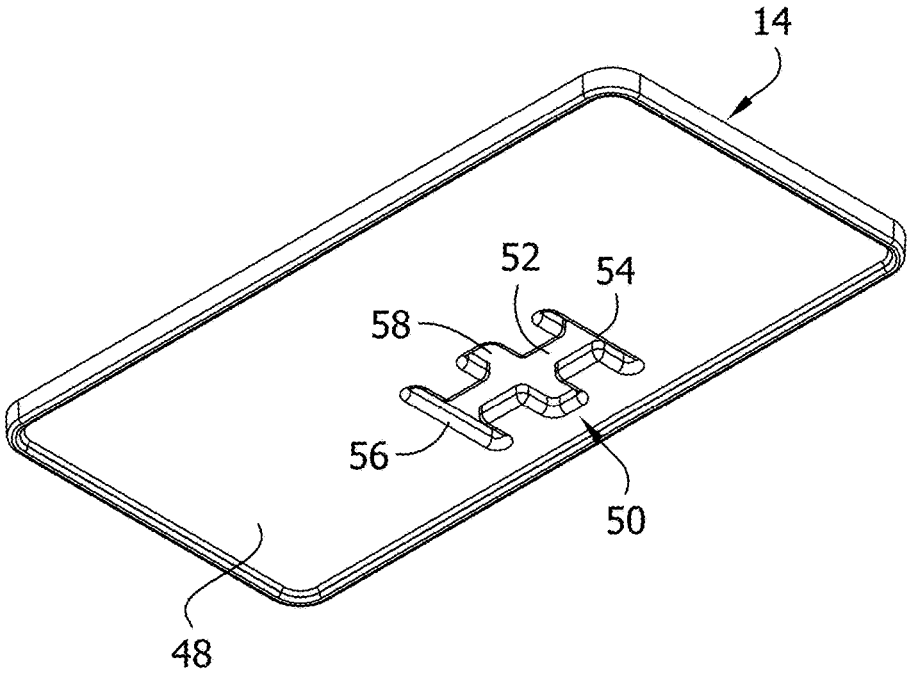
FIG. 9 is a bottom perspective of the disassembled marker.
Figure 9:
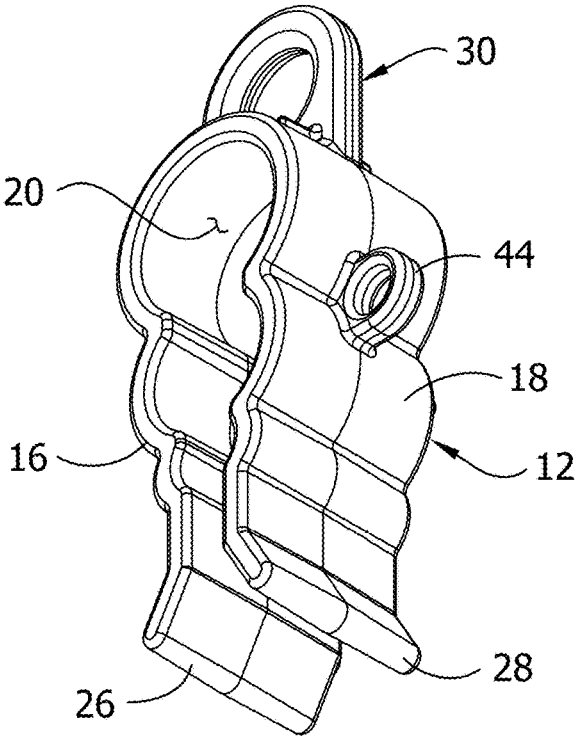

In the illustrated embodiment, the placard 14 is secured to the clip 12 via a direct mating connection that supports the placard against rotation with respect to the clip. In the illustrated embodiment, the placard 14 is a flat, rectangular structure having a first or top side 46 (broadly "face") and a second or bottom side 48. The placard 14 can have any useful peripheral configuration (e.g., other than rectangle) without departing from the scope of the present invention. Desirably, the placard 14 is constructed from a durable, non-conductive material, such as plastic. There is an attachment aperture 50 (broadly "attachment interface") through the material thickness of the placard 14 adjacent one edge of the placard (FIG. 8). Although shown adjacent one longitudinal edge of the placard, the attachment aperture 50 can be located in any convenient part of the placard. When the placard 14 is mounted on the clip 12, the attachment structure 30 extends forward in front of the face 46 of the placard and the legs 16, 18 extend rearward behind the face of the placard.

In the illustrated embodiment, the aperture 50 is cruciform in shape having a first slot 52 extending longitudinally with terminal grooves 54 and 56 at each end. In this embodiment there is a second, transverse slot 58 that bisects the slot 52. As shown in the drawings, the attachment structure 30 fits snugly through the slot 52. The wedge configuration of the detents 38 and 40 allow the structure 30 to slide through the slot 52. The detents 38, 40 gradually push upward and separate opposing edges of the slot 52 so that the placard 14 may pass by the detents toward the raised bosses 34, 36. Once past the detents 38, 40, the opposed edges of the slot 52 snap back to or near their original configuration. In this position, the horizontal undersides of the detents 38, 40 oppose the face 46 of the placard. When the placard 14 is thus affixed to the clip 12 the detents 38, 40 engage the top side of the placard, and the placard cannot be easily removed or dislodged from the clip. The raised bosses 34 and 36 engage the grooves 54 and 56 to stabilize the placard on the clip.

In an alternative arrangement, the structure 30 can be inserted through transverse slot 58 to modify the positional relationship between the clip 12 and the placard 14, depending upon environment. In other words, the placard 14 would be rotated 90° relative to the clip 12. On the other hand, the placard 14 can be constructed with only one or the other of slots 52 or 58 and not both.

The placard 14 is highly versatile. Any type of message or indicia or other useful information may be printed on, or secured to, the placard 14. Such useful information may indicate the connected phase, customer, whether a technician is working remotely on the cable or at the customer site, whether a cable is abandoned and so forth. The type and content of the useful information is limitless. Furthermore, the placard 14 can be color coded on its face or elsewhere to provide instant recognition of the state of the URD line or other safety information. A series of clips and placards may be employed in any environment thereby comprising a complete marking system for URD cables.

In use, the placard 14 is inscribed with desired useful information and/or manufactured in a desired color. The placard 14 is installed on a clip 12 as described. The clip 12 is affixed to the appropriate URD cable by clipping it over the cable. The outwardly directed feet 26 and 28 allow for easy positioning against the cable, and pressure on the clip spreads the legs until the cable snugly seats in the first space 20. The placard 14 is highly visible and imparts information useful to service or installation technicians.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

The invention claimed is:

1. A marker for marking a URD cable, the marker comprising:

a clip including opposing first and second legs, the legs being configured for receiving the URD cable therebetween for mounting the clip on the URD cable;

a placard having a face for displaying information related to the URD cable;

wherein the clip includes an attachment structure and the placard includes an attachment interface, the attachment structure and attachment interface being configured for mating connection with each other for mounting the placard on the clip;

wherein the attachment structure comprises a protrusion and the attachment interface comprises an opening, the opening being sized to receive the protrusion for mounting the placard on the clip;

wherein the protrusion has a hotstick receiving opening therein sized and shaped for being gripped by a hotstick to permit installation of the clip on the cable using the hotstick.

2. A marker as set forth in claim 1, wherein the clip is configured to support the placard against rotation with respect to the clip when the placard is mounted on the clip.

3. A marker as set forth in claim 1, wherein, when the placard is mounted on the clip, the protrusion extends forward in front of the face, the hotstick receiving opening is in front of the face, and the legs extend rearward behind the face.

4. A marker as set forth in claim 1, wherein the protrusion includes at least one detent configured for retaining the placard on the clip.

5. A marker as set forth in claim 1, wherein the hotstick receiving opening has a first mouth at a first side of the hotstick receiving opening and a second mouth at an opposing side of the hotstick receiving opening, and wherein, when the placard is mounted on the clip, the first and second legs are positioned on a first side of the placard and the first and second mouths are positioned on a second side of the placard opposite the first side.

6. A marker as set forth in claim 1, wherein the hotstick receiving opening has a center axis extending through the opening and along which the hotstick is receivable in the opening, and wherein, when the placard is mounted on the clip, the center axis is non-perpendicular to the face of the placard.

7. A marker as set forth in claim 1, wherein the attachment structure and the attachment interface are configured for snap fit mating connection for mounting the placard on the clip.

8. A marker for marking a URD cable, the marker comprising:

a clip including opposing first and second legs having respective distal ends, the legs being configured for receiving the URD cable therebetween for mounting the clip on the URD cable;

a placard rigidly connected to the clip in front of the legs, the placard having a face for bearing and displaying information related to the URD cable;

wherein the connection of the placard to the clip prevents rotation of the placard with respect to the clip, an attachment portion configured for attachment of a hotstick to the marker for use of the hotstick in mounting the clip on the URD cable;

wherein the face of the placard faces in a direction away from the distal ends of the legs, and the attachment portion is in front of the face.

9. A marker as set forth in claim 8, wherein the placard is directly connected to the clip.

10. A marker as set forth in claim 9, wherein the placard is matingly connected to the clip.

11. A marker as set forth in claim 8, wherein the attachment portion extends forward in front of the face and the legs extend rearward behind the face.

12. A marker as set forth in claim 8, wherein the attachment portion includes a hotstick receiving opening having a first mouth at a first side of the hotstick receiving opening and a second mouth at an opposing side of the hotstick receiving opening, the first and second legs being positioned on a first side of the placard, and the first and second mouths being positioned on a second side of the placard opposite the first side.

13. A marker as set forth in claim 8, wherein the attachment portion includes a hotstick receiving opening having a center axis extending through the opening and along which the hotstick is receivable in the opening, the center axis being non-perpendicular to the face of the placard.

14. A method of mounting a marker on a URD cable, the method comprising:

connecting a hotstick to an attachment portion of the marker in front of a placard of the marker;

manipulating the hotstick to push a clip of the marker onto the URD cable to position the URD cable between opposing legs of the clip behind the placard for mounting the clip on the URD cable;

displaying information related to the URD cable on a face of the placard facing forward away from the legs, the placard being rigidly supported by the clip.

15. A method as set forth in claim 14, wherein the placard and clip are formed separately, and the method further comprises mounting the placard on the clip.

16. A method as set forth in claim 15, wherein mounting the placard on the clip comprises matingly connecting the placard and clip.

17. A method as set forth in claim 15, wherein mounting the placard on the clip comprises inserting a protrusion of the clip through an opening in the placard.

18. A method as set forth in claim 17, further comprising retaining the placard on the clip by engagement of the protrusion with a face of the placard.

19. A method as set forth in claim 17, wherein inserting the protrusion of the clip through the opening in the placard forms a snap fit connection of the placard and the clip.

20. A method as set forth in claim 17, wherein connecting the hotstick to the attachment portion comprises connecting the hotstick to the protrusion of the clip.

* * * * *